US007827971B2

(12) United States Patent
Ranganathan et al.

(10) Patent No.: US 7,827,971 B2
(45) Date of Patent: Nov. 9, 2010

(54) ENGINE ASSEMBLY WITH FUEL FILTER GAS REMOVAL APPARATUS

(75) Inventors: Raj P. Ranganathan, Rochester Hills, MI (US); Henry W Harper, Milford, MI (US); Robert D. Straub, Lowell, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 4 days.

(21) Appl. No.: 12/359,723

(22) Filed: Jan. 26, 2009

(65) Prior Publication Data

US 2010/0186724 A1 Jul. 29, 2010

(51) Int. Cl.
*F02M 37/04* (2006.01)

(52) U.S. Cl. ..... 123/510; 123/514; 123/516

(58) Field of Classification Search ..... 123/510, 123/511, 514, 516; 137/115.16; 210/120, 210/188, 194

See application file for complete search history.

(56) References Cited

U.S. PATENT DOCUMENTS 4,011,848 A * 3/1977 Coddington ..... 137/469
4,423,751 A * 1/1984 Roettgen ..... 137/557
4,502,451 A * 3/1985 Duprez ..... 123/516
4,543,938 A * 10/1985 Szlaga ..... 123/514
4,683,055 A * 7/1987 Bosch et al. ..... 210/120
4,706,636 A * 11/1987 Davis ..... 123/557
4,763,684 A * 8/1988 Kelch ..... 137/196
4,926,829 A * 5/1990 Tuckey ..... 123/497
4,933,093 A * 6/1990 Keller ..... 210/774
5,095,880 A * 3/1992 Ricks ..... 123/516
5,207,898 A * 5/1993 Hodgkins ..... 210/136
5,285,759 A * 2/1994 Terada et al. ..... 123/517
5,307,782 A * 5/1994 Davis ..... 123/510
5,355,860 A * 10/1994 Ekstam ..... 123/516
5,413,711 A * 5/1995 Janik ..... 210/300
5,525,225 A * 6/1996 Janik et al. ..... 210/436
5,551,404 A * 9/1996 Bauerle et al. ..... 123/514
5,649,561 A * 7/1997 Brandt ..... 137/115.13
6,007,711 A * 12/1999 Atwood ..... 210/136
6,220,228 B1 * 4/2001 Atkins ..... 123/510
6,247,486 B1 * 6/2001 Schwegler et al. ..... 137/115.27
6,495,032 B2 * 12/2002 Miller et al. ..... 210/130
6,520,162 B1 * 2/2003 Schueler ..... 123/510
6,527,947 B1 * 3/2003 Channing et al. ..... 210/136
6,892,710 B2 * 5/2005 Ekstam ..... 123/514
7,025,048 B2 * 4/2006 Ekstam ..... 123/516
7,150,270 B2 * 12/2006 Hoffmann et al. ..... 123/514

(Continued)

*Primary Examiner*—Thomas N Moulis
(74) *Attorney, Agent, or Firm*—Harness, Dickey & Pierce, P.L.C.

(57) ABSTRACT

An engine assembly may include an engine defining a cylinder bore, a fuel tank, a fuel supply assembly in fluid communication with the fuel tank and the cylinder bore, a fuel return assembly in fluid communication with the fuel supply assembly and the fuel tank, and a fuel filter assembly. The fuel filter assembly may include a filter casing having an inlet, an outlet and a bypass opening, and a filter media located within the filter casing. The filter media may be located between the inlet and the outlet, defining a dirty fuel region of the filter assembly between the inlet and the filter media and a clean fuel region between the filter media and the filter outlet. The bypass opening may be in fluid communication with the dirty fuel region and the fuel return assembly to draw gases out of the dirty fuel region.

20 Claims, 2 Drawing Sheets

U.S. PATENT DOCUMENTS 7,192,518 B2 * 3/2007 Roesgen ..... 210/149
7,568,471 B2 * 8/2009 Harper et al. ..... 123/514
7,591,248 B2 * 9/2009 Mizui et al. ..... 123/468
2009/0020104 A1 * 1/2009 Karasawa et al. ..... 123/530

* cited by examiner

ENGINE ASSEMBLY WITH FUEL FILTER GAS REMOVAL APPARATUS

FIELD

The present disclosure relates to engine fuel systems, and more specifically to removal of gases from fuel filters.

BACKGROUND

This section provides background information related to the present disclosure which is not necessarily prior art.

Engine assemblies may include a fuel system having a fuel filter. The fuel filter may include a filter casing housing a filter media. During engine operation, liquid fuel may be passed through the filter media and delivered to the engine. However, gases such as fuel vapors and air may accumulate in the filter casing, reducing the area of the filter media exposed to liquid fuel.

SUMMARY

An engine assembly may include an engine defining a cylinder bore, a fuel tank, a fuel supply assembly in fluid communication with the fuel tank and the cylinder bore, a fuel return assembly in fluid communication with the fuel supply assembly and the fuel tank to return excess fuel from the fuel supply to the fuel tank, and a fuel filter assembly. The fuel filter assembly may include a filter casing having an inlet, an outlet and a bypass opening, and a filter media located within the filter casing. The filter media may be located between the inlet and the outlet, defining a dirty fuel region of the filter assembly between the inlet and the filter media and a clean fuel region between the filter media and the filter outlet. The bypass opening may be in fluid communication with the dirty fuel region and the fuel return assembly to draw gases out of the dirty fuel region.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 1:
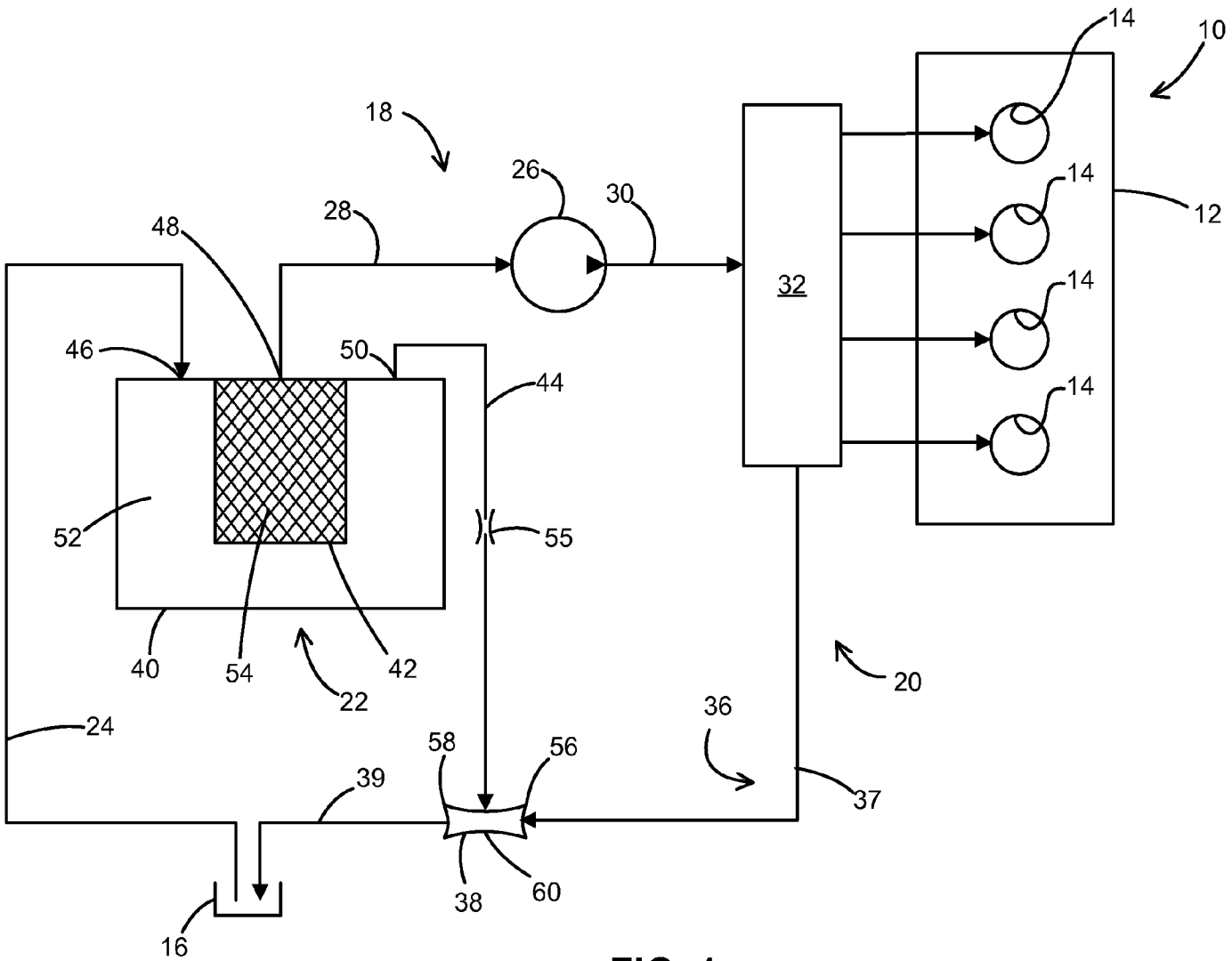
Figure 2:
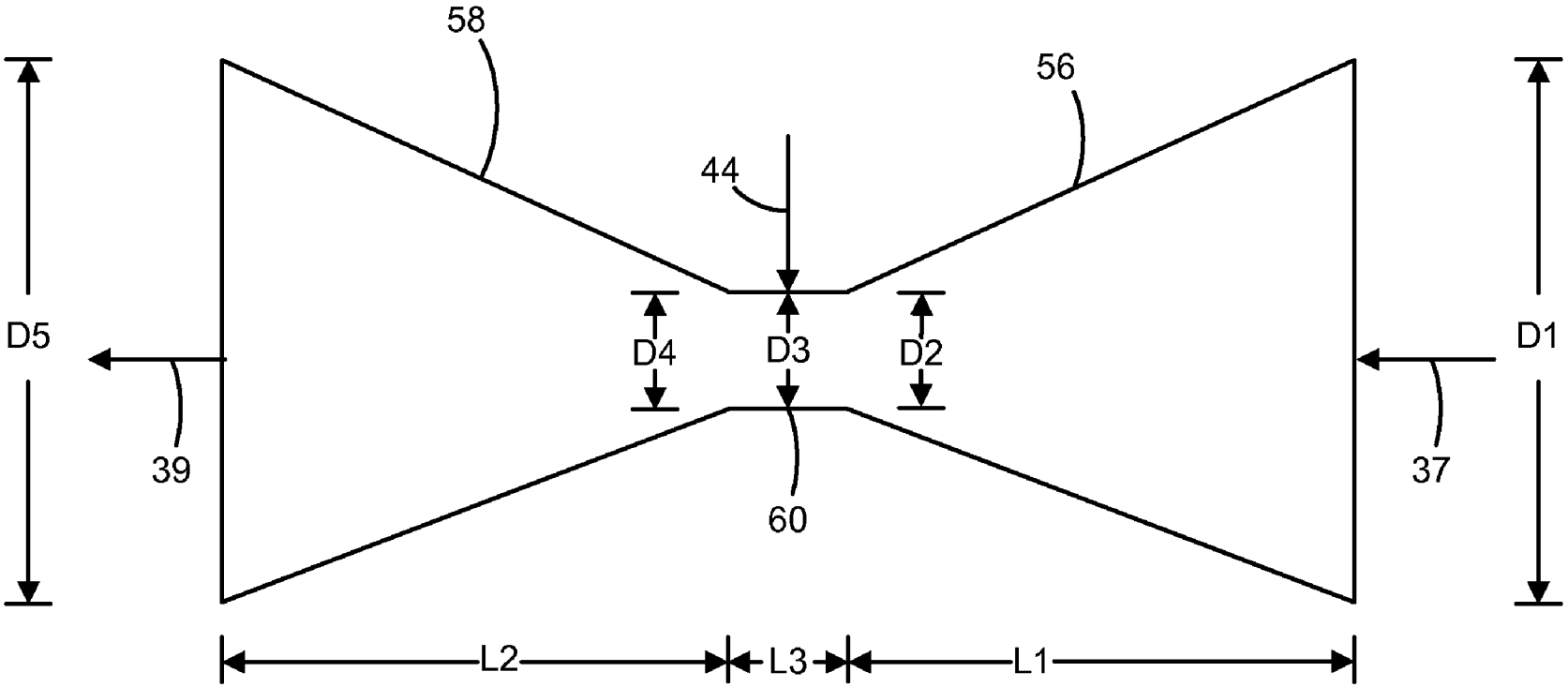

FIG. 1 is a schematic illustration of an engine assembly according to the present disclosure; and FIG. 2 is a schematic illustration of a restriction mechanism of the fuel system of the engine assembly of FIG. 1.

Corresponding reference numerals indicate corresponding parts throughout the several views of the drawings.

DETAILED DESCRIPTION

Example embodiments will now be described more fully with reference to the accompanying drawings.

With reference to FIG. 1, an engine assembly 10 may include an internal combustion engine 12 defining cylinder bores 14 and a fuel system including a fuel tank 16, a fuel supply assembly 18, a fuel return assembly 20, and a fuel filter assembly 22. The fuel supply assembly 18 may supply fuel to the cylinder bores 14 and may include a fuel filter feed 24, a fuel pump 26, a fuel pump feed 28, a fuel supply line 30 and a fuel regulation assembly 32. The fuel filter feed 24 may provide fluid communication between the fuel tank 16 and the fuel filter assembly 22. The fuel pump 26 may include a suction-type pump or a combination suction-type pump and high pressure pump. The fuel pump feed 28 may supply fuel passing through the fuel filter assembly 22 to the fuel pump 26 where the fuel is pressurized and supplied to the fuel regulation assembly 32 via the fuel supply line 30.

The fuel regulation assembly 32 may regulate the supply of pressurized fuel provided to the individual cylinder bores 14. The fuel may be provided to the individual cylinder bores 14 via fuel injectors (not shown) and the pressure supplied to the injectors may be regulated by a pressure regulation mechanism (not shown), such as a valve. By way of non-limiting example, the fuel may be provided to the individual cylinder bores 14 by direct injection. In configurations where the fuel pump 26 is only a suction-type pump, the fuel regulation assembly 32 may include a separate high pressure pump further pressurizing the fuel provided to the fuel injectors. The fuel regulation assembly 32 may include a separate pressure regulation valve or a pressure regulation valve integral to the high pressure pump. The present disclosure applies to a variety of fuels including, but not limited to, diesel fuel and gasoline.

The fuel return assembly 20 may include a fuel return line 36 in fluid communication with the fuel regulation assembly 32 and the fuel tank 16. The fuel return line 36 may include a restriction mechanism 38 located between the fuel tank 16 and the fuel regulation assembly 32, separating the fuel return line 36 into first and second portions 37, 39. The fuel filter assembly 22 may be in fluid communication with the fuel tank 16 as well.

The fuel filter assembly 22 may include a filter casing 40 housing a filter media 42 and a bypass line 44. The filter casing 40 may include an inlet 46, an outlet 48, and a bypass opening 50. The filter media 42 may define a dirty fuel region 52 within the filter casing 40 between the inlet 46 and the filter media 42 and a clean fuel region 54 between the filter media 42 and the filter outlet 48. The bypass opening 50 may be in fluid communication with the dirty fuel region 52 and may be located at an upper portion of the filter casing 40.

Locating the bypass opening 50 at the upper portion of the filter casing 40 may provide fluid communication between a gas-containing portion of the filter casing 40 and the bypass opening 50. The gases within the fuel filter casing 40 may include fuel vapors and air. The gases may accumulate at the upper portion of the fuel filter casing 40 due to the higher density of the liquid fuel within the filter casing 40. Removal of gases from the filter casing 40 may provide an increased exposure of the filter media 42 to liquid fuel, resulting in lower fuel velocities traveling through the filter media 42 and a greater utilization of the entire surface area of the filter media 42. The bypass line 44 may be in fluid communication with the bypass opening 50 and the restriction mechanism 38 to provide flow from the dirty fuel region 52 to the fuel tank 16 via the fuel return line 36, and more specifically, for flow of gases from the filter casing 40 to the fuel tank 16. The bypass line 44 may include a flow limiting mechanism 55, such as an orifice, to limit the amount of flow, and more specifically the amount of liquid fuel flow, through the bypass line 44.

During engine operation, pressurized fuel may be supplied to the engine 12 by the fuel pump 26. Excess fuel may be returned to the fuel tank 16 by the fuel regulation assembly 32. As the fuel returns to the fuel tank 16, it passes through the restriction mechanism 38. As seen in FIG. 2, the restriction mechanism 38 may form a venturi having a converging nozzle portion 56 at an inlet, a diverging nozzle portion (or diffuser) 58 at an outlet, and a duct portion (or throat) 60 between the converging and diverging nozzle portions 56, 58. The converging nozzle portion 56 may have an inlet diameter (D1) at the inlet and an outlet diameter (D2) at the outlet. The inlet diameter (D1) may be approximately equal to the diameter of the first portion 37 of the fuel return line 36. The diameter (D3) of the duct 60 may be approximately equal to the outlet diameter (D2). The diverging nozzle portion 58 may have an inlet diameter (D4) approximately equal to the outlet diameter (D2) of the converging nozzle portion 56 and the diameter (D3) of the duct 60. The diverging nozzle portion 58 may have an outlet diameter (D5). The outlet diameter (D5) may have a diameter approximately equal to the diameter of the second portion 39 of the fuel return line 36. The inlet diameter (D1) of the converging nozzle portion 56 and the outlet diameter (D5) of the diverging nozzle portion 58 may each be greater than the diameter (D3) of the duct 60, and therefore greater than the outlet diameter (D2) and the inlet diameter (D4).

As fuel flows through the restriction mechanism 38, fuel pressure is reduced and velocity is increased as the fuel flows through the duct 60. The fluid pressure within the duct 60 and/or at the entrance to the duct 60 may be less than the fluid pressure within the dirty fuel region 52 of the fuel filter assembly 22 during some engine operating conditions due to varying fuel demand. The second portion 39 of the fuel return line 36 and the outlet diameter (D5) may be sized to provide a low pressure drop from the diverging nozzle portion 58 to the fuel tank 16. The duct 60 may be sized to provide a fuel pressure therein less than the fuel pressure within the dirty fuel region during some engine operating conditions as discussed above to periodically purge the gases from the fuel filter assembly 22.

As the fuel flows from the duct 60 through the diverging nozzle portion 58, the velocity decreases and pressure again increases. The localized increase in velocity and reduction in pressure may draw the gases from within the fuel filter casing 40 to the fuel tank 16. By way of non-limiting example, the bypass line 44 may be in fluid communication with the duct 60 of the restriction mechanism 38. More specifically, the bypass line 44 may be in fluid communication with an outlet of the duct 60. Fuel gases may be drawn from the fuel filter casing 40 of the fuel filter assembly 22 into the fuel return line 36 by the pressure reduction created within the restriction mechanism 38.

What is claimed is:

1. An engine assembly comprising:

an engine defining a cylinder bore;

a fuel tank;

a fuel supply assembly in fluid communication with the fuel tank and the cylinder bore;

a fuel return assembly in fluid communication with the fuel supply assembly and the fuel tank and defining a return flow path from the fuel supply assembly to the fuel tank to return excess fuel from the fuel supply assembly to the fuel tank; and a fuel filter assembly including a filter casing having an inlet in fluid communication with the fuel tank, an outlet in fluid communication with an inlet of the fuel supply assembly and a bypass opening, a filter media located within the filter casing between the inlet and the outlet and defining a dirty fuel region of the filter assembly between the inlet and the filter media and a clean fuel region between the filter media and the filter outlet, the bypass opening being in fluid communication with the dirty fuel region and the return flow path of the fuel return assembly at a location between the outlet of the filter casing and the fuel tank to draw gases out of the dirty fuel region.

2. The engine assembly of claim 1, further comprising a bypass conduit extending from the bypass opening to the fuel return assembly, the bypass conduit including a restriction to limit flow from the dirty fuel region of the fuel filter assembly to the fuel return assembly.

3. The engine assembly of claim 1, wherein the fuel return assembly includes a fuel return line having a restriction mechanism and defining the return flow path, the bypass opening in the fuel filter assembly being in fluid communication with restriction mechanism.

4. The engine assembly of claim 3, wherein the restriction mechanism creates a localized low pressure region in the fuel return line and draws the gases from the dirty fuel region of the fuel filter assembly to the fuel tank.

5. The engine assembly of claim 3, wherein the restriction mechanism includes a venturi.

6. The engine assembly of claim 5, wherein the venturi includes a converging nozzle region receiving a return fuel flow from the fuel supply assembly, a diverging nozzle region, and a duct region located between the converging nozzle region and the diverging nozzle region, the duct region being in fluid communication with the bypass opening.

7. The engine assembly of claim 6, wherein an outlet of the duct region is in fluid communication with the bypass opening.

8. The engine assembly of claim 1, further comprising a bypass conduit extending from the bypass opening to the fuel return assembly and isolated from fluid communication with a clean fuel supply provided by the clean fuel region of the fuel filter assembly to the fuel supply assembly.

9. The engine assembly of claim 1, wherein the bypass opening is located at an upper portion of the filter casing where fuel gases accumulate.

10. The engine assembly of claim 1, wherein fuel is drawn from the filter casing through the bypass opening to the fuel tank before passing through the filter media.

11. A fuel system comprising;

a fuel tank;

a fuel supply assembly in fluid communication with the fuel tank;

a fuel return assembly in fluid communication with the fuel supply assembly and the fuel tank and defining a return flow path from the fuel supply assembly to the fuel tank to return excess fuel from the fuel supply assembly to the fuel tank; and a fuel filter assembly including a filter casing having an inlet in fluid communication with the fuel tank, an outlet in fluid communication with an inlet of the fuel supply assembly and a bypass opening, a filter media located within the filter casing between the inlet and the outlet and defining a dirty fuel region of the filter assembly between the inlet and the filter media and a clean fuel region between the filter media and the filter outlet, the bypass opening being in fluid communication with the dirty fuel region and the return flow path of the fuel return assembly at a location between the outlet of the filter casing and the fuel tank to draw gases out of the dirty fuel region.

12. The fuel system of claim 11, further comprising a bypass conduit extending from the bypass opening to the fuel return assembly, the bypass conduit including a restriction to limit flow from the dirty fuel region of the fuel filter assembly to the fuel return assembly.

13. The fuel system of claim 11, wherein the fuel return assembly includes a fuel return line having a restriction mechanism and defining the return flow path, the bypass opening in the fuel filter assembly being in fluid communication with restriction mechanism.

14. The fuel system of claim 13, wherein restriction mechanism creates a localized low pressure region in the fuel return line and draws the gases from the dirty fuel region of the fuel filter assembly to the fuel tank.

15. The fuel system of claim 13, wherein the restriction mechanism includes a venturi.

16. The fuel system of claim 15, wherein the venturi includes a converging nozzle region receiving a return fuel flow from the fuel supply, a diverging nozzle region, and a duct region located between the converging nozzle region and the diverging nozzle region, the duct region being in fluid communication with the bypass opening.

17. The fuel system of claim 16, wherein an outlet of the duct region is in fluid communication with the bypass opening.

18. The fuel system of claim 11, further comprising a bypass conduit extending from the bypass opening to the fuel return line and isolated from fluid communication with a clean fuel supply provided by the clean fuel region of the fuel filter assembly to the fuel supply assembly.

19. The fuel system of claim 11, wherein the bypass opening is located at an upper portion of the filter casing where fuel gases accumulate.

20. The fuel system of claim 11, wherein fuel is drawn from the filter casing through the bypass opening to the fuel tank before passing through the filter media.

* * * * *